US011062634B2

(12) United States Patent
Duan et al.

(10) Patent No.: US 11,062,634 B2
(45) Date of Patent: Jul. 13, 2021

(54) DRIVE CONTROL METHOD, ASSEMBLY AND DISPLAY DEVICE

(71) Applicants: BEIJING BOE DISPLAY TECHNOLOGY CO., LTD., Beijing (CN); BOE TECHNOLOGY GROUP CO., LTD., Beijing (CN)

(72) Inventors: Xin Duan, Beijing (CN); Xin Wang, Beijing (CN); Hao Zhu, Beijing (CN); Jieqiong Wang, Beijing (CN); Ming Chen, Beijing (CN); Xibin Shao, Beijing (CN)

(73) Assignees: BEIJING BOE DISPLAY TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/620,408

(22) PCT Filed: Jun. 4, 2018

(86) PCT No.: PCT/CN2018/089771
§ 371 (c)(1),
(2) Date: Dec. 6, 2019

(87) PCT Pub. No.: WO2018/223926
PCT Pub. Date: Dec. 13, 2018

(65) Prior Publication Data

US 2020/0135081 A1 Apr. 30, 2020

(30) Foreign Application Priority Data

Jun. 9, 2017 (CN) ..... 201710433781.7

(51) Int. Cl.
*G09G 3/20* (2006.01)

(52) U.S. Cl.
CPC ..... *G09G 3/20* (2013.01); *G09G 2310/0275* (2013.01); *G09G 2310/08* (2013.01); *G09G 2320/0693* (2013.01)

(58) Field of Classification Search
None
See application file for complete search history.

(56) References Cited

U.S. PATENT DOCUMENTS

2015/0302822 A1 10/2015 Lee et al.
2017/0053598 A1 2/2017 Kwon et al.
(Continued)

FOREIGN PATENT DOCUMENTS

CN 1707595 A 12/2005
CN 102955679 A 3/2013
(Continued)

OTHER PUBLICATIONS

"Communication with Supplementary European Search Report", EP Application No. 18813688.1, dated Nov. 3, 2020, 19 pp.
(Continued)

*Primary Examiner* — Stephen T. Reed
(74) *Attorney, Agent, or Firm* — Myers Bigel, P.A.

(57) ABSTRACT

The disclosure relates to a drive control method and assembly, and a display device. A drive control method for a timing controller includes generating a point-to-point configuration instruction including an identity identification of a source driver, wherein the source driver is any of a plurality of source drivers, sending the point-to-point configuration instruction via first signal lines, and receiving a configuration response instruction sent by the source driver via the one of the first signal lines. The configuration response instruction is sent by the source driver after executing the point-to-point configuration instruction in response
(Continued)

to detecting that the identity identification in the instruction is its own identity identification.

17 Claims, 7 Drawing Sheets

(56) References Cited

U.S. PATENT DOCUMENTS

| | | | | |
|---|---|---|---|---|
| 2017/0069257 | A1* | 3/2017 | Lee | G09G 5/005 |
| 2018/0006101 | A1* | 1/2018 | Ha | H01L 27/32 |

FOREIGN PATENT DOCUMENTS

| | | | |
|---|---|---|---|
| CN | 103680374 | A | 3/2014 |
| CN | 106469537 | A | 3/2017 |

OTHER PUBLICATIONS

"Notice of First Review Opinion with English language translation", CN Application No. 201710433781.7, dated Jan. 5, 2021, 32 pp.

* cited by examiner

DRIVE CONTROL METHOD, ASSEMBLY AND DISPLAY DEVICE

CROSS REFERENCE TO RELATED APPLICATIONS

The present application is a 35 U.S.C. 371 national stage application of PCT International Application No. PCT/CN2018/089771, filed on Jun. 4, 2018, which claims the benefit of Chinese Patent Application No. 201710433781.7, filed on Jun. 9, 2017, the entire disclosures of which are incorporated herein by reference.

TECHNICAL FIELD

The disclosure relates to the field of panel manufacturing, and in particular, to a drive control method and assembly, and a display device.

BACKGROUND

A display device generally may comprise a display panel and a panel driving circuit for driving the display panel, the driving circuit may comprise a timing controller (T/CON for short), a gate driving circuit and a source driving circuit, wherein the gate driving circuit comprises a plurality of gate drivers, and the source driving circuit comprises a plurality of source drivers.

In the panel driving circuit, there are usually comprised two signal lines, a first signal line and a second signal line, the signal transmission rate of the first signal line is less than that of the second signal line, the first signal line may be called a low-speed signal line and is usually used for identifying a level state, and the second signal line may be called a high-speed signal line and is usually used for transmitting a high-speed differential signal.

In particular, in a panel driving procedure, signal transmission is generally performed adopting a point-to-point high-speed signal transmission technique, of which the characteristics lie in that a one-to-one second signal line is established between two components (e.g., a timing controller and a source driver) of the panel driving circuit to transmit a high-speed differential signal, usually in an embedded clock manner, and the clock is restored by the source driver according to features of a received signal. Therein, the timing controller is further arranged with an extra first signal line, the plurality of source drivers are connected in parallel and connected to this line, and this first signal line is used for identifying the level state, to cooperate with a second signal line for clock synchronization between the timing controller and a source driver.

SUMMARY

The disclosure provides a drive control method and assembly, and a display device.

According to a first aspect of the disclosure, there is provided a drive control method for a timing controller, the timing controller is coupled to a plurality of source drivers via first signal lines, wherein the source drivers are connected in parallel, and the method may comprise: generating a point-to-point configuration instruction comprising an identity identification of a source driver, wherein the source driver is any of the plurality of source drivers; sending the point-to-point configuration instruction via the first signal lines; and receiving a configuration response instruction sent by the source driver via one of the first signal lines, wherein the configuration response instruction is sent by the source driver in response to the point-to-point configuration instruction.

In an embodiment, the timing controller is coupled to the plurality of source drivers via a plurality of second signal lines, respectively, and before the generating a point-to-point configuration instruction, the method further comprises: configuring the identity identification for the source driver via a target second signal line and one of the first signal lines, wherein the target second signal line is a second signal line connecting the timing controller with the source driver.

In an embodiment, the step of configuring the identity identification for a first source driver via a target second signal line and one of the first signal lines may further comprise: setting a signal on the target second signal line as an unconventional signal so as to designate the source driver as a target source driver and setting signals on signal lines other than the target second signal line in the plurality of second signal lines as a conventional signal, the unconventional signal being different from the conventional signal, and the conventional signal being a signal transmitted by a second signal when it is working normally; and sending an identity configuration instruction via the first signal line, wherein the identity configuration instruction comprises the identity identification to be assigned to the source driver.

In an embodiment, after the sending an identity configuration instruction via the first signal lines, the method further comprises: receiving an identity configuration response instruction sent by the source driver, wherein the identity configuration response instruction comprises an identity identification; examining whether the identity identification in the identity configuration response instruction is the same as the identity identification to be assigned to the source driver; and determining that identity identification configuration of the source driver is successful when the identity identification in the identity configuration response instruction is the same as the identity identification to be assigned to the source driver.

In an embodiment, each instruction transmitted on the first signal line(s) comprises a preamble code, a start identification, data digits and a stop identification that are successively arranged, wherein the preamble code may be configured for instructing a receiving end to perform clock and phase calibration, the start identification may be configured for indicating start of data transmission, the data digits may be configured for carrying configuration data, and the stop identification may be configured for indicating end of data transmission.

In an embodiment, the preamble code may be obtained from at least 8 bits of consecutive binary 0s adopting Manchester encoding, the start identification may comprise at least 2 bits of consecutive binary 0s, the configuration data carried by the data digits may comprise data obtained by adopting Manchester encoding, and the stop identification may comprise at least 2 bits of consecutive binary 1s.

In an embodiment, the second signal line may comprise a differential signal line comprising 2 sub-signal lines, and the step of setting a signal on the target second signal line as the unconventional signal so as to designate the source driver as a target source driver and setting signals on signal lines other than the target second signal line in the plurality of second signal lines as the conventional signal may further comprise: setting signals on the 2 sub-signal lines in the target second signal line to be at the same level, and setting signals on the 2 sub-signal lines comprised by each of the signal lines other than the target second signal line in the plurality of second signal lines to be at different levels.

According to a second aspect of the disclosure, there is provided a drive control method for a source driver, the source driver is any of a plurality of source drivers, the plurality of source drivers are connected in parallel and coupled to a timing controller via first signal lines, and the method may comprise: receiving a point-to-point configuration instruction sent by the timing controller via the first signal lines, wherein the point-to-point configuration instruction comprises an identity identification; detecting whether the identity identification in the point-to-point configuration instruction is that of the source driver; and sending a configuration response instruction to the timing controller via one of the first signal lines in response to the point-to-point configuration instruction after it is determined that the identity identification in the point-to-point configuration instruction is that of the source driver.

In an embodiment, the timing controller may be coupled to the plurality of source drivers via a plurality of second signal lines, respectively, and before the receiving a point-to-point configuration instruction sent by the timing controller via one of the first signal lines, the method further comprises: obtaining the identity identification configured by the timing controller for the source driver via a target second signal line and one of the first signal lines, wherein the target second signal line is a second signal line connecting the timing controller with the source driver.

In an embodiment, the step of obtaining the identity identification configured by the timing controller for the source driver via a target second signal line and one of the first signal lines may further comprise: receiving via one of the first signal lines an identity configuration instruction sent by the timing controller, wherein the identity configuration instruction comprises the identity identification to be assigned; detecting a signal type of a signal on the target second signal line, wherein the signal type may comprise an unconventional signal or a conventional signal; and determining the identity identification to be assigned in the identity configuration instruction as the identity identification of the source driver when the signal on the target second signal line is the unconventional signal; wherein the unconventional signal is different from the conventional signal, and the conventional signal is a signal transmitted by a second signal line when it is working normally.

In an embodiment, after the determining the identity identification in the identity configuration instruction as the identity identification of the source driver, the method may further comprise: sending an identity configuration response instruction to the timing controller, wherein the identity configuration response instruction comprises the identity identification that has been assigned to the source driver.

In an embodiment, the step of sending a configuration response instruction to the timing controller via one of the first signal lines in response to the point-to-point configuration instruction may further comprise: sending the configuration response instruction to the timing controller via one of the first signal lines in response to the point-to-point configuration instruction after an interval of a preset reply wait time starting from receiving the point-to-point configuration instruction.

In an embodiment, the reply wait time may be greater than a suspend time and less than a feedback timeout threshold, and the suspend time is an interval at which the timing controller sends two adjacent instructions.

In an embodiment, each instruction transmitted on the first signal lines may comprise a preamble code, a start identification, data digits and a stop identification that are successively arranged, wherein the preamble code may be configured for instructing a receiving end to perform clock and phase calibration, the start identification may be configured for indicating start of data transmission, the data digits may be configured for carrying configuration data, and the stop identification may be configured for indicating end of data transmission.

In an embodiment, the preamble code may be obtained from at least 8 bits of consecutive binary 0s adopting Manchester encoding, the start identification may comprise at least 2 bits of consecutive binary 0s, the configuration data carried by the data digits may comprise data obtained by adopting Manchester encoding, and the stop identification may comprise at least 2 bits of consecutive binary 1s.

In an embodiment, the second signal line may comprise a differential signal line comprising 2 sub-signal lines, and the step of detecting a signal type of a signal on the target second signal line may further comprise: detecting signals on the 2 sub-signal lines in the target second signal line; determining that the signal on the target second signal line is an unconventional signal when the signals on the 2 sub-signal lines are at the same level; and determining that the signal on the target second signal line is a conventional signal when the signals on the 2 sub-signal lines are at different levels.

According to a third aspect of the disclosure, there is provided a drive control assembly for a timing controller, the timing controller is coupled to a plurality of source drivers via first signal lines, wherein the source drivers are connected in parallel, and the drive control assembly may comprise: a generator which may be configured for generating a point-to-point configuration instruction comprising an identity identification of a source driver, wherein the source driver is any of the plurality of source drivers; a sender which may be configured for sending the point-to-point configuration instruction via the first signal lines; and a receiver which may be configured for receiving a configuration response instruction sent by the source driver via one of the first signal lines, wherein the configuration response instruction is sent by the source driver in response to the point-to-point configuration instruction.

In an embodiment, the timing controller is coupled to the plurality of source drivers via a plurality of second signal lines, respectively, and the drive control assembly may further comprise: a configurator which may be configured for configuring the identity identification for the source driver via a target second signal line and one of the first signal lines, wherein the target second signal line is a second signal line connecting the timing controller with the source driver.

In an embodiment, the configurator may further comprise: a sub-configurator which may be configured for setting a signal on the target second signal line as an unconventional signal so as to designate the source driver as a target source driver and setting signals on signal lines other than the target second signal line in the plurality of second signal lines as a conventional signal, the unconventional signal being different from the conventional signal, and the conventional signal being a signal transmitted by a second signal when it is working normally; and a sub-sender which may be configured for sending an identity configuration instruction via one of the first signal lines, wherein the identity configuration instruction comprises the identity identification to be assigned to the source driver.

In an embodiment, the receiver may further be configured for receiving an identity configuration response instruction sent by the source driver, wherein the identity configuration response instruction comprises an identity identification; and the drive control assembly further comprises: a detector which may be configured for examining whether the identity identification in the identity configuration response instruction is the same as the identity identification to be assigned to the source driver; and a determiner which may be configured for determining that identity identification configuration of the source driver is successful when the identity identification in the identity configuration response instruction is the same as the identity identification to be assigned to the source driver.

In an embodiment, the second signal line may comprise a differential signal line comprising 2 sub-signal lines, and the sub-configurator may be configured for: setting signals on the 2 sub-signal lines in the target second signal line to be at the same level, and setting signals on the 2 sub-signal lines comprised by each of the signal lines other than the target second signal line in the plurality of second signal lines to be at different levels. According to a fourth aspect of the disclosure, there is provided a drive control assembly for a source driver, the source driver is any of a plurality of source drivers, the plurality of source drivers are connected in parallel and coupled to a timing controller via first signal lines, and the drive control assembly may comprise: a receiver which may be configured for receiving a point-to-point configuration instruction sent by the timing controller via one of the first signal lines, wherein the point-to-point configuration instruction comprises an identity identification; a detector which may be configured for detecting whether the identity identification in the point-to-point configuration instruction is that of the source driver; and a sender which may be configured for sending a configuration response instruction to the timing controller via one of the first signal lines in response to the point-to-point configuration instruction after it is determined that the identity identification in the point-to-point configuration instruction is that of the source driver.

In an embodiment, the timing controller may be coupled to the plurality of source drivers via a plurality of second signal lines, respectively, and the drive control assembly may further comprise: an obtainer which may be configured for obtaining the identity identification configured by the timing controller for the source driver via a target second signal line and one of the first signal lines, wherein the target second signal line is a second signal line connecting the timing controller with the source driver.

In an embodiment, the obtainer may further comprise: a sub-receiver which may be configured for receiving via one of the first signal lines an identity configuration instruction sent by the timing controller, wherein the identity configuration instruction comprises the identity identification to be assigned; a sub-detector which may be configured for detecting a signal type of a signal on the target second signal line, wherein the signal type may comprise an unconventional signal or a conventional signal; and a sub-determiner which may be configured for determining the identity identification to be assigned in the identity configuration instruction as the identity identification of the source driver when the signal on the target second signal line is the unconventional signal; wherein the unconventional signal is different from the conventional signal, and the conventional signal is a signal transmitted by a second signal line when it is working normally.

In an embodiment, the sender may be configured for: sending an identity configuration response instruction to the timing controller, wherein the identity configuration response instruction comprises the identity identification that has been assigned to the source driver.

In an embodiment, the second signal line may comprise a differential signal line comprising 2 sub-signal lines, and the sub-detector may further be configured for: detecting signals on the 2 sub-signal lines in the target second signal line; determining that the signal on the target second signal line is an unconventional signal when the signals on the 2 sub-signal lines are at the same level; and determining that the signal on the target second signal line is a conventional signal when the signals on the 2 sub-signal lines are at different levels.

According to a fifth aspect of the disclosure, there is provided a display device comprising: a timing controller and a source driver, the timing controller comprises any of the drive control assemblies for a timing controller as described above, and the source driver comprises any of the drive control assemblies for a source driver as described above.

This Summary introduces some concepts of the disclosure in a simplified form that are further described below in the Detailed Description. This Summary is not intended to give necessary features or essential features of the claimed subject matter, nor is it intended to limit the scope of the claimed subject matter. In addition, as described herein, various other features and advantages may also be incorporated into the techniques as needed. It will be appreciated that, the above general description and the following detailed description are just exemplary, and cannot limit this application.

BRIEF DESCRIPTION OF THE DRAWINGS

In order to more clearly illustrate the technical solutions of some embodiments of the disclosure, the disclosure provides the following appended drawings to be used in the description of the embodiments. It should be appreciated that, the drawings in the following description only relate to some embodiments, and for the person having ordinary skills in the art, other drawings may also be obtained according to these drawings under the premise of not paying out undue experimentation, which other drawings also fall within the scope of the invention.

The drawings herein are incorporated into the specification and constitute a part of the specification, show embodiments in accordance with the principle of the invention, and are used for explaining the principle of the invention along with the specification.

DETAILED DESCRIPTION

To be able to more clearly understand the objects, technical solutions and advantages of some embodiments, in the following, the embodiments will be further described in detail in conjunction with the drawings. It can be appreciated by the person having ordinary skills in the art that, the described embodiments are just a part of embodiments of the invention, and not all the embodiments. Based on the embodiments in the disclosure, all the other embodiments obtained by the person having ordinary skills in the art under the premise of not paying out undue experimentation pertain to the scope protected by the invention.

Figure 1A:
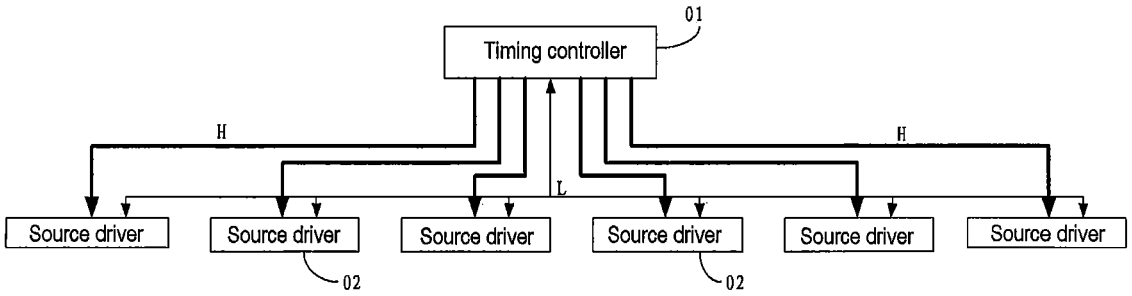
FIG. 1A is a schematic diagram of an application environment of a drive control method provided according to an embodiment of the disclosure.

FIG. 1A is a schematic diagram of an application environment of a drive control method provided according to an embodiment of the disclosure. As shown in FIG. 1A, the drive control method is applied in a display device, which may comprise a timing controller 01 and a plurality of source drivers 02, and the timing controller 01 may be coupled to the plurality of source drivers 02 via a plurality of second signal lines H, respectively. Usually, the plurality of second signal lines H of the timing controller 01 are coupled to the plurality of source drivers 02 in a one to one correspondence, wherein a signal in a second signal line is transmitted in one direction. The timing controller is also coupled to first signal lines L, and the plurality of source drivers 02 are connected in parallel and coupled to the first signal lines L, wherein a signal in the first signal lines is transmitted bi-directionally.

In a panel driving circuit of a traditional display device, the first signal lines L can only perform identification of a level state, for example, a pin of the source driver is set to be at a high level or a low level via the first signal lines L, and therefore, the function of the first signal lines is single, and its utilization rate is low.

Yet in an embodiment of the disclosure, in addition to performing identification of a level state, the first signal lines L may further perform transmission of other instructions to implement different data transmission functions, of which each corresponds to at least one transmission mode. For example, the timing controller may implement a function of sending a broadcast configuration instruction to the source drivers via the first signal lines, which function corresponds to a broadcast mode, that is, the broadcast mode indicates that the timing controller performs data broadcast; the timing controller may further send an identity configuration instruction to the source driver via the first signal lines to implement a function of sending an identity identification (ID for short) for the source driver, which function corresponds to an ID assignment (IA for short) mode, that is, the ID assignment mode indicates that the timing controller perform ID assignment for the source driver; and the timing controller may further send a point-to-point (also called end-to-end) configuration instruction to the source driver via the first signal lines, to implement a function of point-to-point control of the source driver, which function corresponds to a downstream communication (DC for short) mode, that it, the downstream communication mode indicates that the timing controller performs point-to-point data transmission on the source driver. The source driver may send a control response instruction with respect to the point-to-point configuration instruction to the timing controller via one of the first signal lines, or send an identity configuration response instruction with respect to the identity configuration instruction to the timing controller via one of the first signal lines, and this function corresponds to a reply transmission (RT for short) mode, that is, the reply transmission mode indicates that the source driver performs an instruction reply to the timing controller. By cooperation of the above individual modes, the timing controller may successively accomplish operations of ID assignment to the source driver, read/write operation of data, receiving data feedback from the source driver, and so on.

In an embodiment, formats of instructions transmitted between the timing controller and the source driver are the same, and each of the instructions transmitted on the first signal lines may comprise a preamble code, a start identification, data digits (also called a transmission body) and a stop identification that are successively arranged.

Therein, the preamble code may be configured for instructing a receiving end to perform clock and phase calibration. When detecting that there is a preamble code transmitted on the first signal lines, the receiving end (the timing controller or the source driver) performs clock and phase adjustment according to content of the preamble code, wherein the clock and phase adjustment is meant to keep that the clock is consistent with that of the sending end and the phase is the same as that of the sending end, the receiving end adjusts the clock and phase in the procedure of receiving the preamble code, and the clock and phase adjustment is finished after the preamble code transmission is ended. The start identification may be configured for indicating start of data transmission, the data digits may be configured for carrying configuration data, and the stop identification may be configured for indicating end of data transmission.

Figure 1B:
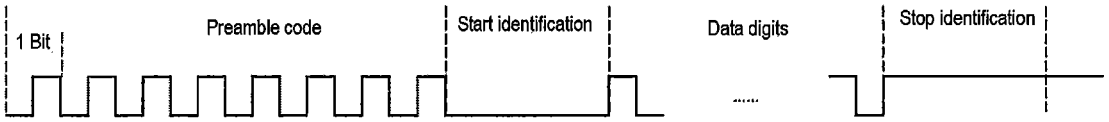
FIG. 1B is a schematic diagram of a format of a signal transmitted on a first signal line provided according to an embodiment of the disclosure.

For example, the preamble code may be obtained from at least 8 bits of consecutive binary 0s adopting Manchester encoding. FIG. 1B schematically illustrates the preamble code is obtained from 8 bits of consecutive binary 0s adopting Manchester encoding. The start identification may keep a low level signal and Manchester encoding will not performed on it, for example, it may comprise at least 2 bits of consecutive binary 0s, and FIG. 1B schematically illustrates the start identification is 2 bits of consecutive binary 0s. The configuration data carried by the data digits may comprise data obtained by adopting Manchester encoding. The stop identification may keep a high level signal and Manchester encoding will not performed on it, it may comprise at least 2 bits of consecutive binary 1 s, and FIG. 1B schematically illustrates the stop identification is 2 bits of consecutive binary 1s.

It is noted that, since adoption of Manchester encoding may cause data to produce a clear jumping edge, which facilitates detection of the data, data that needs to be encoded may adopt Manchester encoding. However, in a practical application, it may also be possible to adopt other encoding approaches or not to perform encoding. Further, as shown in FIG. 1B, in order to ensure that the configuration data carried by the data digits can be effectively recognized at a decoding end, the first digit of the configuration data in the data digits may form a jumping edge with the start identification (that is, the numerical value of the first digit of the configuration data in the data digits is different from that of the last digit of the start identification, for example, the first digit of the configuration data in the data digits is 1, and the last digit of the start identification is 0). The last digit of the configuration data in the data digits may form a jumping edge with the stop identification (that is, the numerical value of the last digit of the configuration data in the data digits is different from that of the first digit of the stop identification, for example, the last digit of the configuration data in the data digits is 0, and the last digit of the stop identification is 1). The above mentioned jumping edges may facilitate the receiving end to perform effective recognition of data.

In the above different instructions, the configuration data carried by the data digits may comprise a signal which may be configured for indicating a transmission mode of the first signal line, which transmission mode may be the broadcast mode, the ID assignment mode, the downstream communication mode or the reply transmission mode as described above. The signal which may be configured for indicating a transmission mode of the first signal line may occupy 2 bits in the data digits. It may be possible to determine the current mode of data transmission by detecting this signal.

For example, the instructions transmitted on the first signal lines may comprise a broadcast configuration instruction, a point-to-point transmission instruction, an identity configuration instruction, an identity configuration response instruction or a configuration response instruction. The broadcast configuration instruction, the point-to-point transmission instruction and the identity configuration instruction are sent by the timing controller to the source driver. The transmission mode of the broadcast configuration instruction is the broadcast mode, the transmission mode of the point-to-point transmission instruction is the downstream communication mode, and the transmission mode of the identity configuration instruction is the ID assignment mode. The identity configuration response instruction and the configuration response instruction are sent by the source driver to the timing controller. The identity configuration response instruction is a response instruction with respect to the identity configuration information, and the configuration response instruction is a response instruction with respect to the point-to-point transmission instruction. The transmission modes of both the identity configuration response instruction and the configuration response instruction are the reply transmission mode.

Further, the configuration data in the data digits of the broadcast configuration instruction may further comprise the number of second signal lines (also called the number of high-speed channels), a transmission rate (that is, transmission rate of data on an individual signal line) and signal equalizer (EQ for short) information. Assume that the receiving end of the point-to-point configuration instruction is a source driver, and then the configuration data carried by the data digits of the point-to-point configuration instruction may further comprise an identity identification of the source driver, and an address, an operation type, and data corresponding to an operation indicated by the operation type, of a register needing to be configured on the source driver, and so on.

Figure 2:
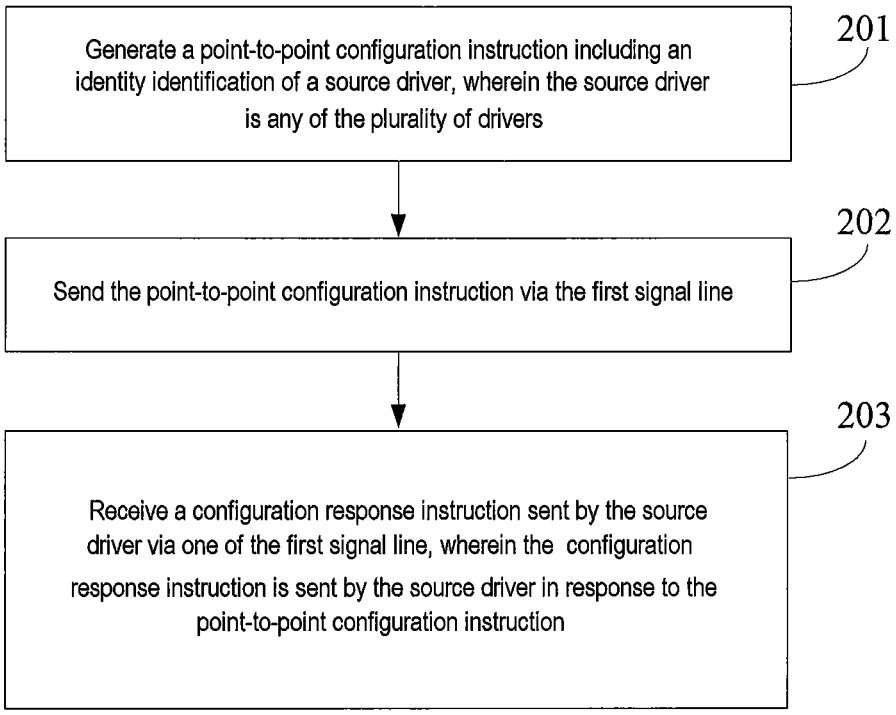
FIG. 2 is a flow diagram of a drive control method provided according to an embodiment of the disclosure.

FIG. 2 is a flow diagram of a drive control method provided according to an embodiment of the disclosure, which drive control method may be applied to the timing controller in FIG. 1A, which timing controller is coupled to a plurality of source drivers via first signal lines, the plurality of source drivers being connected in parallel. As shown in FIG. 2, the method may comprise:

step 201, generating a point-to-point configuration instruction comprising an identity identification of a source driver, wherein the source driver is any of the plurality of source drivers;

step 202, sending the point-to-point configuration instruction via the first signal lines; and step 203, receiving a configuration response instruction sent by the source driver via one of the first signal lines, wherein the configuration response instruction is sent by the source driver in response to the point-to-point configuration instruction. In particular, after detecting that the identity identification in the point-to-point configuration instruction is that of the source driver, the source driver determines that it itself is just a configuration object of the point-to-point configuration instruction, then performs the point-to-point configuration instruction and sends the configuration response instruction to the timing controller.

In the above drive control method, since the point-to-point configuration instruction can be sent via the first signal lines, to implement point-to-point control of the individual source drivers by the timing controller, thereby enriching the functions of the first signal lines and improving the utilization rate of the first signal lines.

Figure 3:
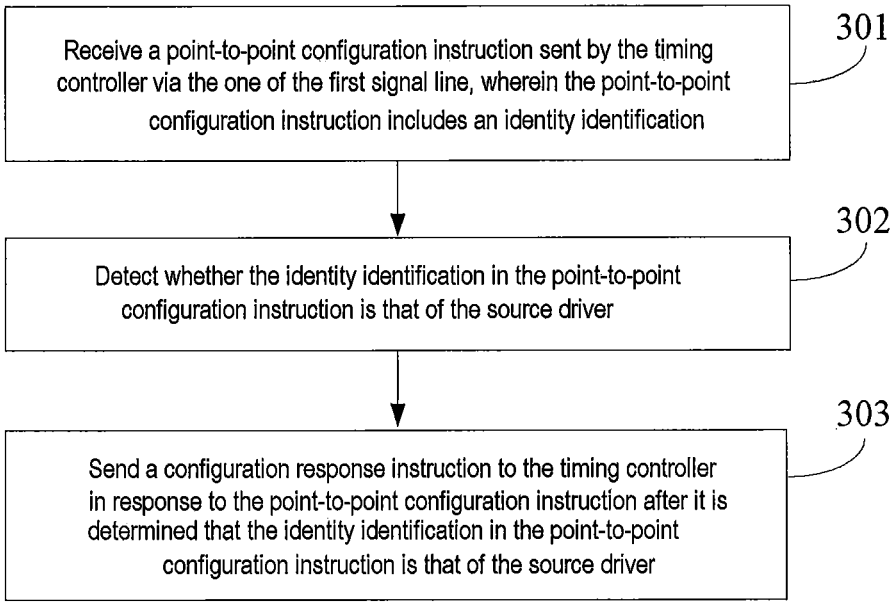
FIG. 3 is a flow diagram of a drive control method provided according to an embodiment of the disclosure.

FIG. 3 is a flow diagram of a drive control method provided according to an embodiment of the disclosure, the drive control method may be applied to a source driver in FIG. 1A, the source driver is any of a plurality of source drivers, and the plurality of source drivers are connected in parallel and coupled to a timing controller via first signal lines. As shown in FIG. 3, the method may comprise:

step 301, receiving a point-to-point configuration instruction sent by the timing controller via the first signal lines, wherein the point-to-point configuration instruction comprises an identity identification;

step 302, detecting whether the identity identification in the point-to-point configuration instruction is that of the source driver; and step 303, sending a configuration response instruction to the timing controller in response to the point-to-point configuration instruction after it is determined that the identity identification in the point-to-point configuration instruction is that of the source driver.

In the above drive control method, since the point-to-point configuration instruction sent by the timing controller can be received via the first signal lines, to implement point-to-point control of the source driver by the timing controller, thereby enriching the functions of the first signal lines and improving the utilization rate of the first signal lines.

It is noted that, in a traditional panel driving circuit, an embedded clock manner is usually adopted, the clock is restored by the source driver by features of a signal received by a second signal line, and an extra first signal line is used to identify the level state.

Based on this characteristic, it is usually necessary to make corresponding preparations before transmitting display data, for example, perform clock calibration to ensure that the working clocks of the timing controller and the source driver keep synchronous. Therefore, for part of configuration instructions transmitted in a second signal line, it is necessary to complete the preparations (e.g., clock synchronization) before it can be transmitted. Some functions that need to be set after power-on initialization (before clock synchronization of the second signal line) are usually set by setting the level of a pin of the source driver to be high (or low). As such, the flexibility of its commissioning or setup is limited, and even when the level of the pin needs to be modified, this involves the revision design of the component, which results in unnecessary consumption.

Figure 4A:
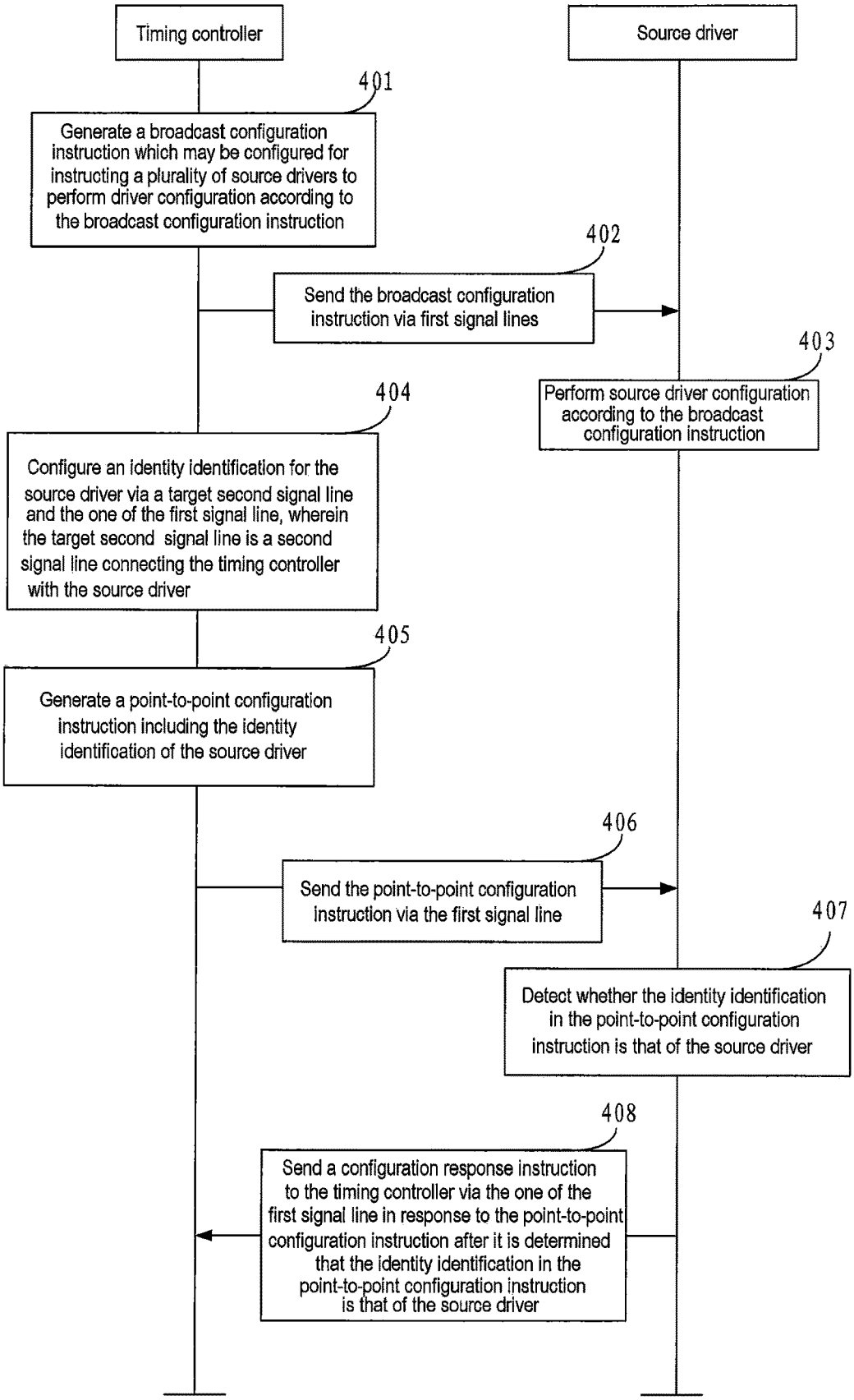
FIG. 4A is a flow diagram of a drive control method provided according to an embodiment of the disclosure.

However, in some embodiments of the disclosure, by the broadcast configuration instruction and/or the point-to-point configuration instruction, data transmission may be performed before the clock synchronization of the second signal line. Especially for some functions that need to be set after the power-on initialization, they may be implemented by the broadcast configuration instruction and/or the point-to-point configuration instruction adopting the first signal lines, which does not need to modify the design of the component, and reduces unnecessary consumption. In particular, reference is made to FIG. 4A, which is a flow diagram of a drive control method provided according to an embodiment of the disclosure, which drive control method may be applied in the application environment in FIG. 1A. The method may comprise the following steps.

At step 401, a timing controller generates a broadcast configuration instruction which may be configured for instructing a plurality of source drivers to perform configuration according to the broadcast configuration instruction.

In this embodiment, the broadcast configuration instruction may carry data that needs to be configured for individual source drivers before clock synchronization of second signal lines, thereby implementing unified configuration of data of the individual source drivers after power-on, for example, the broadcast configuration instruction may comprise the number of second signal lines, a transmission rate and signal equalizer information.

At step 402, the timing controller sends the broadcast configuration instruction via first signal lines.

At step 403, a source driver performs source driver configuration according to the broadcast configuration instruction.

After receiving the broadcast configuration instruction sent by the timing controller via the first signal lines, the source driver may perform configuration according to the broadcast configuration instruction. This component configuration procedure is a basic initialization setting when a connection is established for a high-speed channel. For example, when the broadcast configuration instruction may comprise the number of second signal lines with which each source driver is connected, the source driver saves the number of second signal lines with which it is connected, and the source driver needs to determine the number of second signal lines for which calibration preparation is made in a clock calibration phase according to this setting, for example, whether it is required for one second signal line to meet the calibration condition, or it is required for two second signal lines to meet the calibration condition. It is noted that, when the second signal lines are differential signal lines, one second signal line is actually a differential signal line consisting of two sub-signal lines. When the broadcast configuration instruction comprises a transmission rate, the transmission rate is used for informing the source driver of the transmission rate at the time of signal transmission to be performed, and when performing the clock calibration, the source driver can accurately work at the agreed transmission rate. The signal equalizer information may be used for indicating shift positions of signal gain, and different signal equalizer information may indicate signal gain of a different shift position. When the broadcast configuration instruction comprises the signal equalizer information, a signal received by the source driver may be enhanced according to the signal equalizer information, and thereby when a received signal cannot be correctly received after attenuation, the signal can be raised to the range of normal reception of the source driver after signal enhancement is performed according to the shift position indicated by the signal equalizer information. By a different gain setting, a source driver at a different position may obtain a state in which the signal magnitude is similar. Therefore, when the signal equalizer information is used for adjusting a signal received by the source driver, by the magnitude of gain for a signal, a data signal that can be normally received is thereby obtained.

It is noted that, in general, one source driver is coupled to one second signal line; however, in some special scenarios, one second signal line may not meet the transmission requirements of a source driver, and therefore, one source driver may also be coupled to at least two second signal lines according to the situation. In a practical application, the broadcast configuration instruction may comprise the number of second signal lines with which each source driver is connected. However, when the numbers of second signal lines with which all the source drivers are connected are the same, the broadcast configuration instruction may carry one number of second signal lines, which indicates that each source driver is configured according to this number, for example, the carried number is 1, that is, each source driver is coupled to 1 second signal line.

At step 404, the timing controller may configure an identity identification for the source driver via a target second signal line and one of the first signal lines, wherein the target second signal line is a second signal line connecting the timing controller with the source driver.

It is noted that, the identity identification of the source driver is configured by the timing controller in agreement with the source driver in advance, and this may ensure that the timing controller effectively recognizes the source driver. In the embodiment, a way in which the identity identification of the source driver is configured by the timing controller in agreement with the source driver in advance is usually software configuration.

Figure 4B:
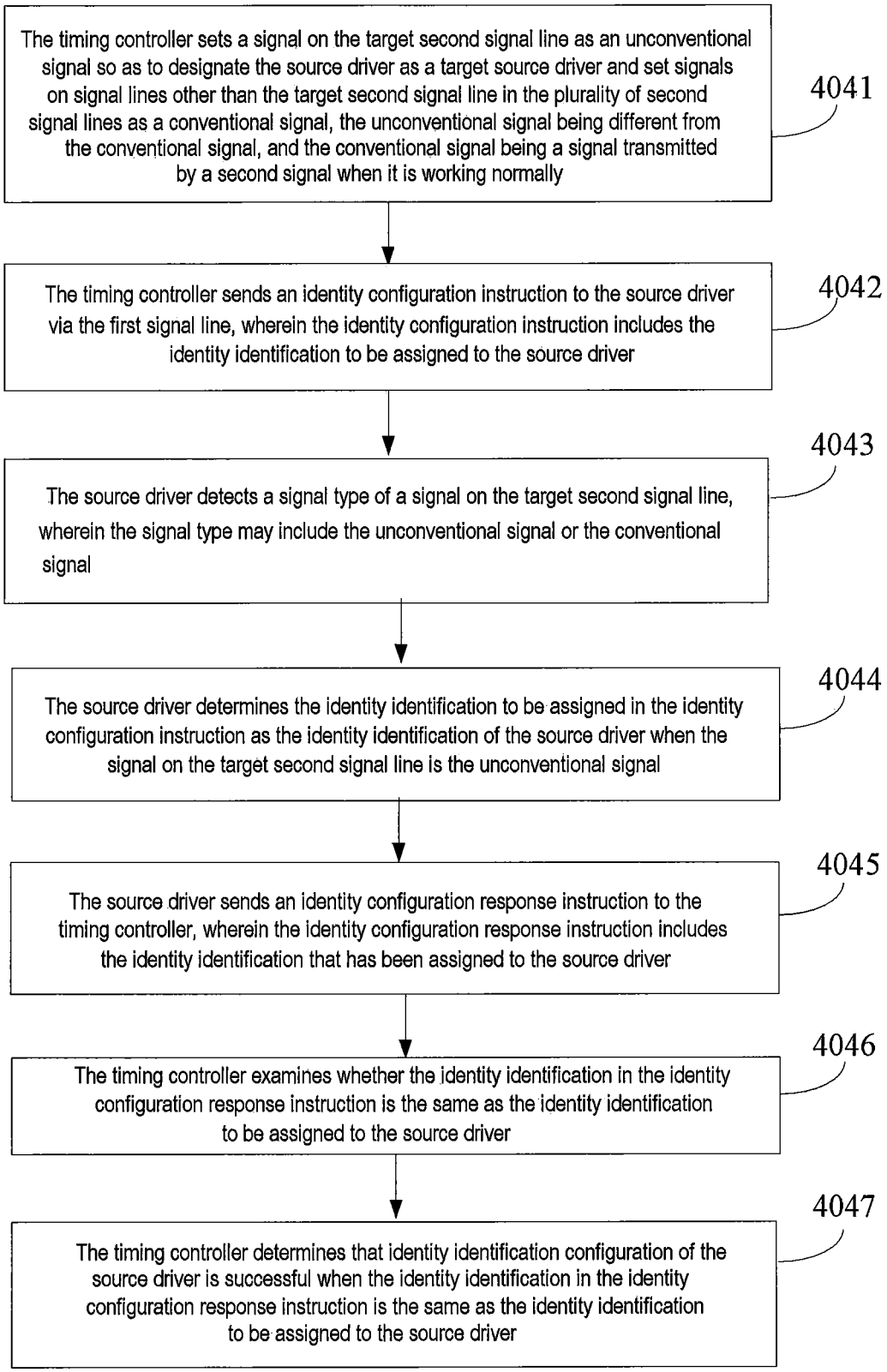
FIG. 4B is a flow diagram of identity identification configuration provided according to an embodiment of the disclosure.

For example, it may be possible to configure the identity identification for the source driver via the target second signal line and one of the first signal lines, to implement software configuration. The procedure of this software configuration is simple and convenient, which may improve the flexibility of signal transmission between the timing controller and the source driver, and reduce the complexity of configuration. As shown in FIG. 4B, a procedure of configuring the identity identification for the source driver via the target second signal line and one of the first signal lines may comprise the following steps.

At step 4041, the timing controller sets a signal on the target second signal line as an unconventional signal so as to designate the source driver as a target source driver and sets signals on signal lines other than the target second signal line in the plurality of second signal lines as a conventional signal, the unconventional signal being different from the conventional signal, and the conventional signal being a signal transmitted by a second signal when it is working normally.

Since the timing controller needs to perform identity identification configuration for the individual source drivers, and such a procedure of identity identification configuration is actually a time-divisional configuration procedure, that is, the period of time in which an identity identification is configured for a different source driver is different. In a procedure of configuring an identity identification for a source driver, to ensure that the source driver knows that the period of time is one in which the timing controller configures an identity identification for it, the timing controller needs to providing corresponding prompt information to the source driver. In an embodiment, the prompt information may be implemented based on the second signal line. Assume that a signal transmitted when a high-speed signal is working normally is a conventional signal, and by setting a signal on the target second signal line as an unconventional signal different from the conventional signal to differentiate between it and the conventional signal and setting signals on signal lines other than the target second signal line in the plurality of second signal lines as the conventional signal, the unconventional signal may be recognized since the first source driver knows the form of the conventional signal, thereby achieving the prompting effect.

A second signal line is usually a differential signal line, and performs data transmission in a differential transmission manner. Differential transmission is a signal transmission technique. Different from a traditional practice of one signal line and one ground line, the differential transmission transmits signals on both the lines, and for the signals transmitted on the two lines, their amplitudes are equal and their phases are opposite. The signals transmitted on these two lines are a differential signal. Therefore, in an embodiment, the differential signal line comprises 2 sub-signal lines, and when it is working normally, the levels of the 2 sub-signal lines are different, that is, the level of one signal line is a high level, and the level of the other signal line is a low level.

A procedure of setting a signal on the target second signal line as an unconventional signal and setting signals on signal lines other than the target second signal line in the plurality of second signal lines as a conventional signal may comprise: setting signals on the 2 sub-signal lines in the target second signal line to be at the same level, for example, setting both the 2 sub-signal lines to be at a low level or at a high level, and setting signals on the 2 sub-signal lines comprised by each of the signal lines other than the target second signal line in the plurality of second signal lines to be at different levels.

At step 4042, the timing controller sends an identity configuration instruction to the source driver via the first signal lines, wherein the identity configuration instruction comprises the identity identification to be assigned to the source driver.

At step 4043, the source driver detects a signal type of a signal on the target second signal line, wherein the signal type may comprise the unconventional signal or the conventional signal.

After the source driver receives via one of the first signal lines an identity configuration instruction sent by the timing controller, the source driver detects a signal type of a signal on the target second signal line coupled to the source driver. As described at the step 4041, a second signal line is usually a differential signal line, the differential signal line comprises 2 sub-signal lines, and when it is working normally, the levels of the 2 sub-signal lines are different. Therefore, a procedure in which the source driver detects a signal type of a signal on the target second signal line may comprise: the source driver detecting signals on the 2 sub-signal lines in the target second signal line; the source driver determining the signal on the target second signal line as the unconventional signal when the levels of the signals on the 2 sub-signal lines are the same; and the source driver determining the signal on the target second signal line as the conventional signal when the levels of the signals on the 2 sub-signal lines are different.

At step 4044, the source driver determines the identity identification to be assigned in the identity configuration instruction as the identity identification of the source driver when the signal on the target second signal line is the unconventional signal.

Since the plurality of source drivers are connected in parallel, and connected in series with the first signal lines, the individual source drivers may all receive identity control information each time the timing controller sends an identity configuration instruction via the first signal lines, and a source driver may determine that an identity identification carried in the identity configuration instruction is configured for itself and then receive the identity identification when it determines that the signal on a target second signal line corresponding to it is an unconventional signal, and the source driver may determine that the identity identification carried in the identity configuration instruction is not configured for itself and may not process the identity configuration instruction when it determines that the signal on the target second signal line corresponding to it is a conventional signal.

It can be seen from the above that the second signal line plays a role of prompt in the software configuration procedure, and the first signal line plays a role of instruction transmission in the software configuration procedure.

At step 4045, the source driver sends an identity configuration response instruction to the timing controller, wherein the identity configuration response instruction comprises the identity identification that has been assigned to the source driver.

In an embodiment, after determining the identity identification in the identity configuration instruction as the identity identification of the source driver, the source driver may send an identity configuration response instruction carrying the identity identification assigned to the respective source driver to the timing controller, to prompt the timing controller that the source driver has finished configuration of identity identification.

At step 4046, the timing controller examines whether the identity identification in the identity configuration response instruction is the same as the identity identification to be assigned to the source driver.

After receiving the identity configuration response instruction sent by the source driver, the timing controller may examine whether the identity identification in the identity configuration response instruction is the same as the identity identification to be assigned to the source driver.

At step 4047, the timing controller determines that identity identification configuration of the source driver is successful when the identity identification in the identity configuration response instruction is the same as the identity identification to be assigned to the source driver.

It is noted that, when the identity identification in the identity configuration response instruction is different from the identity identification to be assigned to the source driver, the timing controller may determine that the instruction transmission between the timing controller and the source driver is abnormal, and the timing controller and the source driver may re-perform the above steps 4041 to 4047, until the timing controller determines that the identity identification in the identity configuration response instruction is the same as the identity identification to be assigned to the source driver.

It is worth noting that, if the timing controller has not yet received the identity configuration response instruction sent by the source driver in a preset time (this preset time may be equal to a preset feedback timeout threshold) after the step 4042, the timing controller may determine that the source driver's reply times out and the instruction transmission between the two is abnormal, and the timing controller and the source driver may re-perform the above steps 4041 to 4047, until the timing controller receives the identity configuration response instruction sent by the source driver in the preset time after sending the identity configuration instruction.

In an embodiment, when the second signal line is a differential signal line, signals on the two lines of the differential signal line coupled to the source driver may be pulled low, the source driver recognizes that the timing controller is performing an assignment operation on itself (namely, operation of configuring identity information) by the change of the differential signal line, and after receiving the identity configuration instruction sent by the timing controller, the source driver takes the identity identification carried therein as its own identity identification and passes it back to the timing controller, and it is determined by the timing controller whether the assignment is successful. This procedure may rapidly and effectively implement assignment for the source driver.

The above mentioned first signal line is a special signal line, and it may transmit an instruction for a corresponding source driver and receive a response instruction transmitted by the source driver, implementing bi-directional transmission of signals.

At step 405, the timing controller generates a point-to-point configuration instruction comprising the identity identification of the source driver.

The timing controller may perform point-to-point control of a single source driver via a point-to-point instruction. In an embodiment, the point-to-point configuration instruction may carry data that a single source driver needs to configure before synchronization of a second signal line, thereby implementing separate configuration of data of each source driver. When it is needed to perform a read operation or a write operation on a source driver, the data digits of the point-to-point configuration instruction may comprise: an address, an operation type, and data corresponding to an operation indicated by the operation type, of a register needing to be configured on the source driver. The operation type may be a read type or a write type.

At step 406, the timing controller sends the point-to-point configuration instruction via the first signal lines.

At step 407, the source driver detects whether the identity identification in the point-to-point configuration instruction is that of the source driver.

After receiving the point-to-point configuration instruction sent by the timing controller via the one of the first signal lines, the source driver detects whether the identity identification comprised in the point-to-point configuration instruction is its own identity identification; when the identity identification comprised in the point-to-point configuration instruction is not its own identification, it indicates that the point-to-point configuration instruction is not itself-directed; and if the identity identification comprised in the point-to-point configuration instruction is its own identification, it indicates that the point-to-point configuration instruction is a itself-directed configuration instruction.

At step 408, the source driver sends a configuration response instruction to the timing controller via the one of the first signal lines in response to the point-to-point configuration instruction after it is determined that the identity identification in the point-to-point configuration instruction is that of the source driver.

After determining that the identity identification in the point-to-point configuration instruction is that of the source driver, the source driver may perform an operation indicated by the point-to-point configuration instruction, for example, a read operation or a write operation, or a component setting operation, and after performing a corresponding operation, generates a configuration response instruction for indicating that instruction execution is completed and sends it to the timing controller.

It is noted that, when sending the configuration response instruction to the timing controller in response to the point-to-point configuration instruction, the source driver may send the configuration response instruction to the timing controller in response to the point-to-point configuration instruction at an interval of a preset reply wait time starting from receiving the point-to-point configuration instruction.

The reply wait time may be greater than a suspend time and less than a feedback timeout threshold, wherein the suspend time may be 10 us, and the feedback timeout threshold may be 300 us, that is, the reply wait time may be greater than 10 us and less than 300 us.

Therein, the suspend time is also called a standby time, and is the time of an interval at which the timing controller sends two adjacent instructions; and that the reply wait time of the source driver is greater than the suspend time may avoid that the source driver sends an instruction when transmission of one instruction sent by the timing controller is not completed, which results in line conflict. The feedback timeout threshold is pre-set, and when an interval from receiving the point-to-point configuration instruction to a moment at which the configuration response instruction of the source driver is sent is greater than the feedback timeout time, it may be considered that the configuration response instruction is invalid and loses timeliness, and it is meaningless to send it again. Therefore, the reply wait time may be greater than the suspend time, and that it is less than the feedback timeout threshold may guarantee the validity of the configuration response instruction.

In a conventional display panel, a configuration instruction for a source driver can only be controlled by a second signal line, however, because of depending on the second signal line, when the second signal line is not ready at a power-on initialization phase, part of configuration information cannot be configured by such a method. Yet some embodiments of the disclosure causes that only one first signal line may also accomplish data transmission mainly by the first signal line independent of the second signal line, by defining a unique signal instruction sequence as shown in FIG. 1B and adopting Manchester encoding, thereby enriching the functions of the first signal line and improving the utilization rate of the first signal line. Meanwhile, on a basis that all the source drivers are connected in parallel on one first signal line, independent control of a specific source driver or overall control of multiple source drivers is accomplished with different working modes and configuration instruction content by cooperation with the level state of a second signal line, which does not need to modify the design of a component and reduces unnecessary consumption.

Figure 5A:
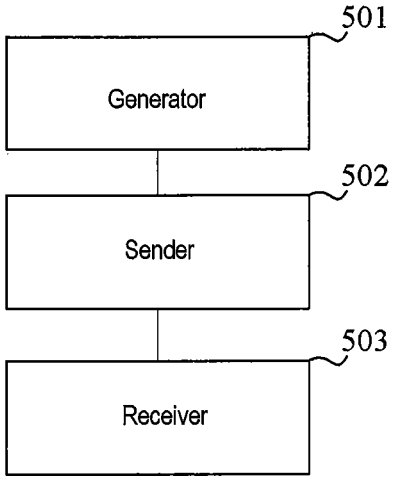
FIG. 5A is a structure diagram of a drive control assembly provided according to an embodiment of the disclosure.

It is noted that, the order of the steps of the driver control methods provided by the embodiments of the disclosure may be appropriately adjusted, the steps may also be increased or decreased accordingly according to the situation, various variations of the methods may easily occur to any technician familiar with the technical field within the technical scope disclosed by the invention, and these variations should all be encompassed within the protection scope of the invention and therefore will not be repeated any longer. FIG. 5A shows a drive control assembly for a timing controller provided according to an embodiment of the disclosure. With reference to 1A, the timing controller is coupled to a plurality of source drivers via first signal lines, wherein the source drivers are connected in parallel, and the drive control assembly may comprise:

a generator 501 which may be configured for generating a point-to-point configuration instruction comprising an identity identification of a source driver, wherein the source driver is any of the plurality of source drivers;

a sender 502 which may be configured for sending the point-to-point configuration instruction via the first signal lines; and a receiver 503 which may be configured for receiving a configuration response instruction sent by the source driver via the first signal line, wherein the configuration response instruction is sent by the source driver in response to the point-to-point configuration instruction. In particular, after detecting that the identity identification in the point-to-point configuration instruction is the identity identification of the source driver, the source driver determines that it itself is just the destination of the point-to-point configuration instruction, then executes the point-to-point configuration instruction and sends a configuration response instruction.

In the above drive control assembly, since the sender can send a point-to-point configuration instruction via the first signal lines to implement point-to-point control of an individual source driver by the timing controller, thereby enriching the functions of the first signal line and improving the utilization rate of the first signal line.

Figure 5B:
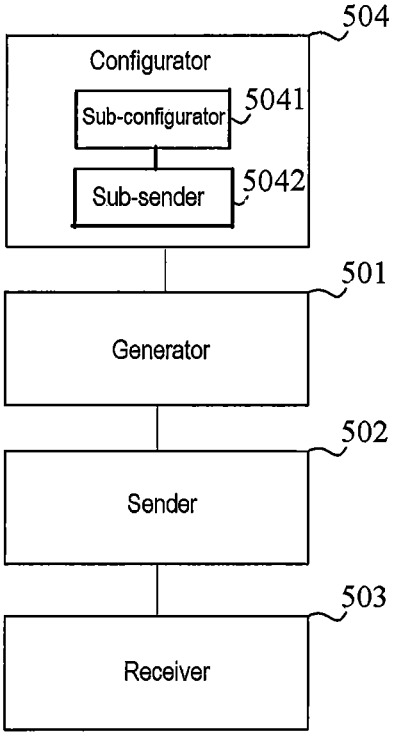
FIG. 5B is a structure diagram of another drive control assembly provided according to an embodiment of the disclosure.

FIG. 5B shows a structure diagram of another drive control assembly provided according to an embodiment of the disclosure. In this embodiment, the timing controller is coupled to the plurality of source drivers via a plurality of second signal lines, respectively. In addition to the components or modules shown in FIG. 5A, the drive control assembly as shown in FIG. 5B further comprises:

a configurator 504 which may be configured for configuring the identity identification for the source driver via a target second signal line and the one of the first signal lines, wherein the target second signal line is a second signal line connecting the timing controller with the source driver.

In an embodiment, the configurator 504 may further comprise:

a sub-configurator 5041 which may be configured for setting a signal on the target second signal line as an unconventional signal and setting signals on signal lines other than the target second signal line in the plurality of second signal lines as a conventional signal, the unconventional signal being different from the conventional signal, and the conventional signal being a signal transmitted by a second signal when it is working normally; and a sub-sender 5042 which may be configured for sending an identity configuration instruction to the first source driver via the first signal line, wherein the identity configuration instruction comprises the identity identification to be assigned to the source driver.

Figure 5C:
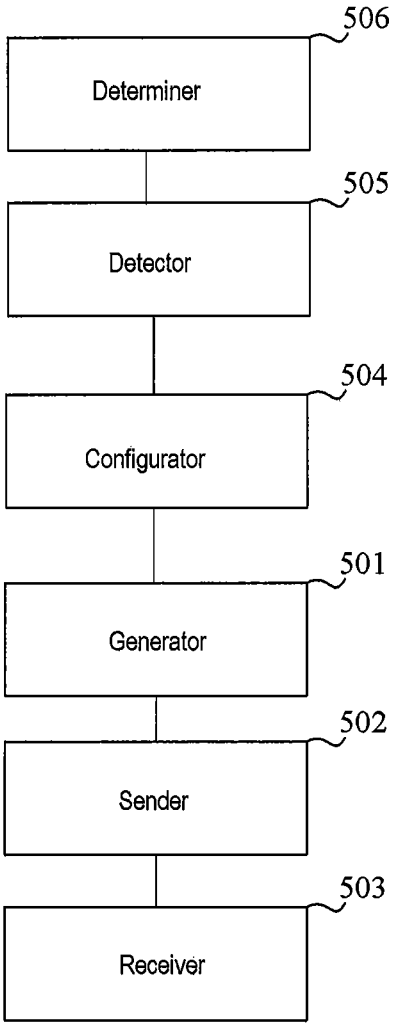
FIG. 5C is a structure diagram of still another drive control assembly provided according to an embodiment of the disclosure.

FIG. 5C shows a structure diagram of still another drive control assembly provided according to an embodiment of the disclosure. In this embodiment, the receiver 503 shown in FIG. 5C may further be configured for receiving an identity configuration response instruction sent by the source driver, wherein the identity configuration response instruction comprises an identity identification.

Furthermore, in addition to the components or modules shown in FIG. 5B, the drive control assembly shown in FIG. 5C further comprises:

a detector 505 which may be configured for examining whether the identity identification in the identity configuration response instruction is the same as the identity identification assigned to the source driver; and a determiner 506 which may be configured for determining that identity identification configuration of the source driver is successful when the identity identification in the identity configuration response instruction is the same as the identity identification assigned to the source driver.

In an embodiment, each instruction transmitted on the first signal lines comprises a preamble code, a start identification, data digits and a stop identification that are successively arranged, wherein the preamble code may be configured for instructing a receiving end to perform clock and phase calibration, the start identification may be configured for indicating start of data transmission, the data digits may be configured for carrying configuration data, and the stop identification may be configured for indicating end of data transmission.

In an embodiment, the preamble code may be obtained from at least 8 bits of consecutive binary 0s adopting Manchester encoding;

the start identification may comprise at least 2 bits of consecutive binary 0s;

the configuration data carried by the data digits may comprise data obtained by adopting Manchester encoding; and the stop identification may comprise at least 2 bits of consecutive binary 1s.

In an embodiment, two adjacent instructions sent by the timing controller are separated by a preset suspend time.

In an embodiment, the second signal line is a differential signal line comprising 2 sub-signal lines, and the sub-configurator may further be configured for:

setting signals on the 2 sub-signal lines in the target second signal line to be at the same level, and setting signals on the 2 sub-signal lines comprised by each of the signal lines other than the target second signal line in the plurality of second signal lines to be at different levels.

In an embodiment, the generator 501 may further be configured for generating a broadcast configuration instruction which is used for instructing the plurality of source drivers to perform configuration according to the broadcast configuration instruction. The sender 502 may further be configured for sending the broadcast configuration instruction via the first signal lines.

In the above drive control assembly, since the sender can send a point-to-point configuration instruction via the first signal lines to implement point-to-point control of an individual source driver by the timing controller, thereby enriching the functions of the first signal line and improving the utilization rate of the first signal line.

Figure 6A:
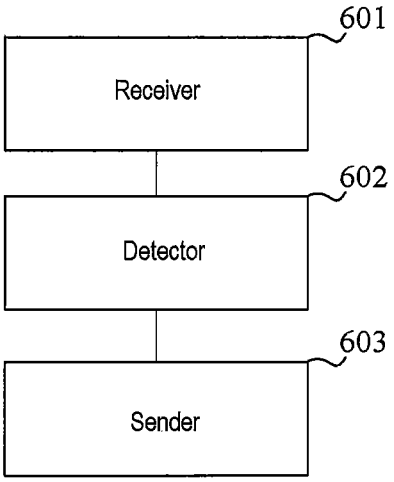
FIG. 6A is a structure diagram of a drive control assembly provided according to an embodiment of the disclosure.

FIG. 6A shows a structure diagram of a drive control assembly for a source driver provided according to an embodiment of the disclosure. The drive control assembly may be used for any of the plurality of source drivers in FIG. 1A. As shown in FIG. 1A, the plurality of source drivers are connected in parallel, and coupled to a timing controller via first signal lines. As shown in FIG. 6A, the drive control assembly may comprise:

a receiver 601 which may be configured for receiving a point-to-point configuration instruction sent by the timing controller via the one of the first signal lines, wherein the point-to-point configuration instruction comprises an identity identification;

a detector 602 which may be configured for detecting whether the identity identification in the point-to-point configuration instruction is that of the source driver; and a sender 603 which may be configured for sending a configuration response instruction to the timing controller via the one of the first signal lines in response to the point-to-point configuration instruction after it is determined that the identity identification in the point-to-point configuration instruction is that of the source driver.

In the above drive control assembly, since the receiver can receive via the first signal line the point-to-point configuration instruction sent by the timing controller, to implement point-to-point control of the source driver by the timing controller, thereby enriching the functions of the first signal line and improving the utilization rate of the first signal line.

Figure 6B:
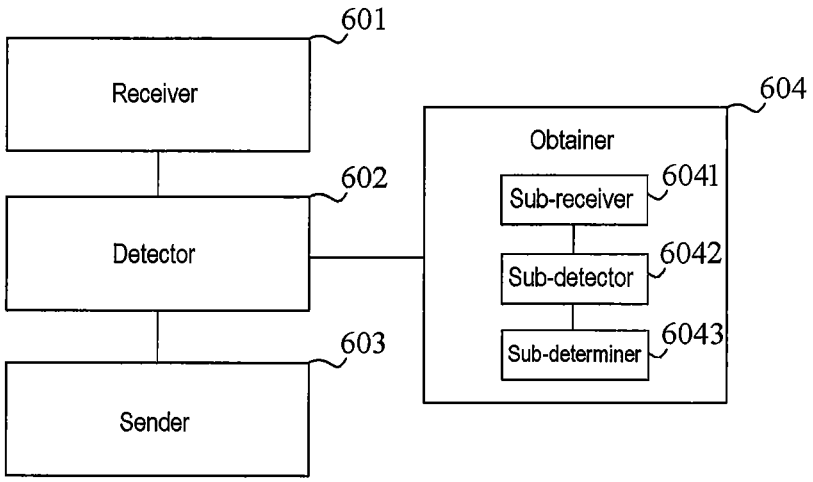
FIG. 6B is a structure diagram of another drive control assembly provided according to an embodiment of the disclosure.

FIG. 6B shows a structure diagram of another drive control assembly provided according to an embodiment of the disclosure. In this embodiment, the timing controller is coupled to the plurality of source drivers via a plurality of second signal lines, respectively. In addition to the modules or components shown in FIG. 6A, the drive control assembly as shown in FIG. 6B may further comprise:

an obtainer 604 which may be configured for obtaining the identity identification configured by the timing controller for the source driver via a target second signal line and the one of the first signal lines, wherein the target second signal line is a second signal line connecting the timing controller with the source driver.

In an embodiment, the obtainer 604 may further comprise:

a sub-receiver 6041 which may be configured for receiving via the one of the first signal lines an identity configuration instruction sent by the timing controller, wherein the identity configuration instruction comprises the identity identification;

a sub-detector 6042 which may be configured for detecting a signal type of a signal on the target second signal line, wherein the signal type is an unconventional signal or a conventional signal; and a sub-determiner 6043 which may be configured for determining the identity identification in the identity configuration instruction as the identity identification of the source driver when the signal on the target second signal line is the unconventional signal;

wherein the unconventional signal is different from the conventional signal, and the conventional signal is a signal transmitted by a second signal line when it is working normally.

In an embodiment, the sender 603 may further be configured for: sending an identity configuration response instruction to the timing controller, wherein the identity configuration response instruction comprises the identity identification of the source driver.

In an embodiment, the sender 603 may be configured for:

sending the configuration response instruction to the timing controller via the one of the first signal lines in response to the point-to-point configuration instruction after an interval of a preset reply wait time starting from receiving the point-to-point configuration instruction.

In an embodiment, the reply wait time may be greater than a suspend time and less than a feedback timeout threshold, and the suspend time is an interval at which the timing controller sends two adjacent instructions.

In an embodiment, each instruction transmitted on the first signal lines comprises a preamble code, a start identification, data digits and a stop identification that are successively arranged, wherein the preamble code may be configured for instructing a receiving end to perform clock and phase calibration, the start identification may be configured for indicating start of data transmission, the data digits may be configured for carrying configuration data, and the stop identification may be configured for indicating end of data transmission.

In an embodiment, the preamble code may be obtained from at least 8 bits of consecutive binary 0s adopting Manchester encoding;

the start identification may comprise at least 2 bits of consecutive binary 0s;

the configuration data carried by the data digits may comprise data obtained by adopting Manchester encoding; and the stop identification may comprise at least 2 bits of consecutive binary 1s.

In an embodiment, the second signal line is a differential signal line comprising 2 sub-signal lines, and the sub-detector may be configured for:

detecting signals on the 2 sub-signal lines in the target second signal line;

determining that the signal on the target second signal line is an unconventional signal when the signals on the 2 sub-signal lines are at the same level; and determining that the signal on the target second signal line is a conventional signal when the signals on the 2 sub-signal lines are at different levels.

In an embodiment, the receiver 601 may further be configured for receiving a broadcast configuration instruction sent by the timing controller via the first signal lines. The drive control assembly may further comprise a configurator which may be configured for performing configuration according to the broadcast configuration instruction.

In the above drive control assembly, since the receiver can receive via the first signal line the point-to-point configuration instruction sent by the timing controller, to implement point-to-point control of the first source driver by the timing controller, thereby enriching the functions of the first signal line and improving the utilization rate of the first signal line.

According to a further aspect of the disclosure, there is provided a display device comprising: a timing controller and a source driver, of which a connection manner may be referred to FIG. 1A. The timing controller may comprise a drive control assembly as described in any of FIG. 5A to FIG. 5C, and the source driver may comprise a drive control assembly as described in FIG. 6A or FIG. 6B.

The display device may be any product or component with the display function, such as a liquid crystal panel, an electronic paper, an organic light emitting diode (abbr. OLED) panel, a mobile phone, a tablet computer, a television, a display, a notebook computer, a digital photo frame, a navigator, etc.

It may be clearly understood by the person having skills in the art that, for convenience and brevity of description, some specific working procedures of the above described device, assembly and modules have been omitted, and these specific working procedures may also be referred to corresponding procedures in the above described method embodiments and will not be repeated here any longer.

It may be appreciated that, what are described above are just exemplary embodiments of the invention, however, the protective scope of the invention is not limited thereto. It should be pointed out that, various variations or alternatives may readily occur to the person having ordinary skills in the art, and these variations or alternatives should all be encompassed in the protective scope of the invention, without departing from the spirit and principle of the invention. Therefore, the protective scope of the invention should be subject to the protective scope of the appended claims.

It is noted that, the above embodiments are just illustrated by division of the above various functional modules, and in a practical application, the above functions may be allocated to different functional modules for accomplishment as needed. It may be possible to divide the internal structure of a device into different functional modules to accomplish all or part of the above described functions. In addition, the function of one module described above may be accomplished by multiple modules, and the functions of multiple modules described above may also be integrated into one module for accomplishment.

Various techniques may be described herein in the general context of software, hardware elements, or program modules. Generally, such modules comprise routines, programs, objects, elements, components, data structures, and so forth that perform particular tasks or implement particular abstract data types. The terms "module," "functionality," and "component" as used herein generally represent software, firmware, hardware, or a combination thereof. The features of the techniques described herein are platform-independent, meaning that the techniques may be implemented on a variety of computing platforms having a variety of processors.

In this application, wordings such as "first", and "second", etc. are used. When there is no additional context, use of such wordings does not aim at implying ordering, and in fact, they are just used for the purpose of identification. For example, the phrases "first signal line" and "second signal line" do not necessarily mean that the first signal line is located before the second signal line in terms of position, or also do not mean that the first signal line operates, or is processed before the second signal line in terms of time. In fact, the phrases are just used to identify different signal lines.

In the claims, any reference sign placed between the parentheses shall not be construed as limiting to a claim. The term "comprise" does not exclude the presence of an element or a step other than those listed in a claim. The word "a" or "an" preceding an element does not exclude the presence of a plurality of such elements. The invention may be implemented by means of hardware comprising several distinct elements, or also by suitably programmed software or firmware, or by any combination thereof.

In an apparatus or system claim enumerating several devices, one or more of the devices may be embodied by one and the same hardware item. The mere fact that certain measures are recited in mutually different dependent claims does not indicate that a combination of these measures cannot be used to advantage.

What is claimed is:

1. A drive control method for a timing controller, wherein the timing controller is coupled to a plurality of source drivers via first signal lines, and wherein the source drivers are connected in parallel, the method comprising:

generating a point-to-point configuration instruction comprising an identity identification of a source driver of the plurality of source drivers;

sending the point-to-point configuration instruction via the first signal lines; and receiving a configuration response instruction sent by the source driver via one of the first signal lines, wherein the configuration response instruction is sent by the source driver in response to the point-to-point configuration instruction, wherein the timing controller is coupled to the plurality of source drivers via a plurality of second signal lines, respectively, and before the generating the point-to-point configuration instruction, the drive control method further comprising:

configuring the identity identification for the source driver of the plurality of source drivers via a target second signal line and one of the first signal lines, wherein the target second signal line is a second signal line of the plurality of second signal lines connecting the timing controller with the source driver, wherein the configuring further comprises:

setting a signal on the target second signal line as an unconventional signal to designate the source driver as a target source driver and setting signals on signal lines other than the target second signal line in the plurality of second signal lines as a conventional signal, wherein the unconventional signal is different from the conventional signal, and wherein the conventional signal is a signal transmitted by the second signal line when working normally, and sending an identity configuration instruction via the first signal lines, wherein the identity configuration instruction comprises the identity identification to be assigned to the source driver;

receiving an identity configuration response instruction sent by the source driver, wherein the identity configuration response instruction comprises an identity identification;

examining whether the identity identification in the identity configuration response instruction is same as the identity identification to be assigned to the source driver; and determining that identity identification configuration of the source driver is successful when the identity identification in the identity configuration response instruction is same as the identity identification to be assigned to the source driver.

2. The drive control method as claimed in claim 1, wherein each instruction transmitted on the first signal lines comprises a preamble code, a start identification, data digits and a stop identification that are successively arranged, and wherein the preamble code is configured for instructing a receiving end to perform clock and phase calibration, the start identification is configured for indicating start of data transmission, the data digits are configured for carrying configuration data, and the stop identification is configured for indicating end of data transmission.

3. The drive control method as claimed in claim 2, wherein the preamble code is obtained from at least 8 bits of consecutive binary 0s adopting Manchester encoding, wherein the start identification comprises at least 2 bits of consecutive binary 0s, wherein the configuration data carried by the data digits comprises data obtained by adopting Manchester encoding, and wherein the stop identification comprises at least 2 bits of consecutive binary 1s.

4. The drive control method as claimed in claim 1, wherein the second signal line comprises a differential signal line comprising 2 sub-signal lines, and wherein the setting the signal on the target second signal line as the unconventional signal comprises:

setting signals on the 2 sub-signal lines in the target second signal line to be at a same level, and setting signals on the 2 sub-signal lines comprised of each of the signal lines other than the target second signal line in the plurality of second signal lines to be at different levels.

5. A drive control method for a source driver of a plurality of source drivers, wherein the plurality of source drivers are connected in parallel and coupled to a timing controller via first signal lines, the drive control method comprising:

receiving a point-to-point configuration instruction sent by the timing controller via one of the first signal lines, wherein the point-to-point configuration instruction comprises an identity identification;

detecting whether the identity identification in the point-to-point configuration instruction is that of the source driver; and sending a configuration response instruction to the timing controller via the one of the first signal lines in response to the point-to-point configuration instruction after it is determined that the identity identification in the point-to-point configuration instruction is that of the source driver, wherein the timing controller is coupled to the plurality of source drivers via a plurality of second signal lines, respectively, and wherein before the receiving the point-to-point configuration instruction sent by the timing controller via the one of the first signal lines, the drive control method further comprises:

obtaining the identity identification configured by the timing controller for the source driver via a target second signal line and the one of the first signal lines, wherein the target second signal line is a second signal line connecting the timing controller with the source driver, and wherein the obtaining further comprises:

receiving via the one of the first signal lines an identity configuration instruction sent by the timing controller, wherein the identity configuration instruction comprises the identity identification to be assigned;

detecting a signal type of a signal on the target second signal line, wherein the signal type may comprise an unconventional signal or a conventional signal; and determining the identity identification to be assigned in the identity configuration instruction as the identity identification of the source driver when the signal on the target second signal line is the unconventional signal, wherein the unconventional signal is different from the conventional signal, and the conventional signal is a signal transmitted by the second signal line when working normally;

wherein the second signal line comprises a differential signal line comprising 2 sub-signal lines, and wherein the detecting the signal type of the signal on the target second signal line comprises:

detecting signals on the 2 sub-signal lines in the target second signal line;

determining that the signal on the target second signal line is the unconventional signal when the signals on the 2 sub-signal lines are at a same level; and determining that the signal on the target second signal line is the conventional signal when the signals on the 2 sub-signal lines are at different levels.

6. The drive control method as claimed in claim 5, wherein after the determining the identity identification in the identity configuration instruction as the identity identification of the source driver, the drive control method further comprises:

sending an identity configuration response instruction to the timing controller, wherein the identity configuration response instruction comprises the identity identification that has been assigned to the source driver.

7. The drive control method as claimed in claim 5, wherein the sending the configuration response instruction to the timing controller via the one of the first signal lines in response to the point-to-point configuration instruction comprises:

sending the configuration response instruction to the timing controller via the one of the first signal lines in response to the point-to-point configuration instruction after an interval of a preset reply wait time starting from receiving the point-to-point configuration instruction.

8. The drive control method as claimed in claim 7, wherein the preset reply wait time is greater than a suspend time and less than a feedback timeout threshold, and wherein the suspend time is an interval at which the timing controller sends two adjacent instructions.

9. The drive control method as claimed in claim 5, wherein each instruction transmitted on the first signal lines comprises a preamble code, a start identification, data digits and a stop identification that are successively arranged, and wherein the preamble code is configured for instructing a receiving end to perform clock and phase calibration, the start identification is configured for indicating start of data transmission, the data digits are configured for carrying configuration data, and the stop identification is configured for indicating end of data transmission.

10. The drive control method as claimed in claim 9, wherein the preamble code is obtained from at least 8 bits of consecutive binary 0s adopting Manchester encoding, wherein the start identification comprises at least 2 bits of consecutive binary 0s, wherein the configuration data carried by the data digits is data obtained by adopting Manchester encoding, and wherein the stop identification may comprise at least 2 bits of consecutive binary 1s.

11. A drive control assembly for a timing controller, wherein the timing controller is coupled to a plurality of source drivers via first signal lines, and wherein the source drivers are connected in parallel, the drive control assembly comprising:

a generator configured for generating a point-to-point configuration instruction comprising an identity identification of a source driver of the plurality of source drivers;

a sender configured for sending the point-to-point configuration instruction via the first signal lines; and a receiver configured for receiving a configuration response instruction sent by the source driver via the one of the first signal lines, wherein the configuration response instruction is sent by the source driver in response to the point-to-point configuration instruction, wherein the timing controller is coupled to the plurality of source drivers via a plurality of second signal lines, respectively, and the drive control assembly further comprises:

a configurator configured for configuring the identity identification for the source driver via a target second signal line and the one of the first signal lines, wherein the target second signal line is a second signal line connecting the timing controller with the source driver, and the configurator further comprises:

a sub-configurator configured for setting a signal on the target second signal line as an unconventional signal so as to designate the source driver as a target source driver and setting signals on signal lines other than the target second signal line in the plurality of second signal lines as a conventional signal, wherein the unconventional signal is different from the conventional signal, and the conventional signal is a signal transmitted by the second signal line when working normally, and a sub-sender configured for sending an identity configuration instruction via the first signal lines, wherein the identity configuration instruction comprises the identity identification to be assigned to the source driver, wherein the second signal line comprises a differential signal line comprising 2 sub-signal lines, and wherein the sub-configurator is further configured to perform operations comprising:

setting signals on the 2 sub-signal lines in the target second signal line to be at a same level, and setting signals on the 2 sub-signal lines comprised by each of the signal lines other than the target second signal line in the plurality of second signal lines to be at different levels.

12. The drive control assembly as claimed in claim 11, wherein the receiver is further configured for receiving an identity configuration response instruction sent by the source driver, wherein the identity configuration response instruction comprises an identity identification, and wherein the drive control assembly further comprises:

a detector configured for examining whether the identity identification in the identity configuration response instruction is same as the identity identification to be assigned to the source driver; and a determiner which may be configured for determining that identity identification configuration of the source driver is successful when the identity identification in the identity configuration response instruction is same as the identity identification to be assigned to the source driver.

13. A drive control assembly for a source driver of a plurality of source drivers, wherein the plurality of source drivers are connected in parallel and coupled to the timing controller of claim 11 via first signal lines, wherein the receiver is configured for receiving a point-to-point configuration instruction sent by the timing controller via the first signal lines, wherein the point-to-point configuration instruction comprises an identity identification, the drive control assembly comprising:

a detector configured for detecting whether the identity identification in the point-to-point configuration instruction is that of the source driver; and a sender configured for sending a configuration response instruction to the timing controller via the one of the first signal lines in response to the point-to-point configuration instruction after it is determined that the identity identification in the point-to-point configuration instruction is that of the source driver.

14. The drive control assembly as claimed in claim 13, wherein the timing controller is coupled to the plurality of source drivers via a plurality of second signal lines, respectively, and the drive control assembly further comprises:

an obtainer configured for obtaining the identity identification configured by the timing controller for the source driver via a target second signal line and the one of the first signal lines, wherein the target second signal line is a second signal line of the plurality of second signal lines connecting the timing controller with the source driver, wherein the obtainer further comprises:

a sub-receiver configured for receiving via the one of the first signal lines an identity configuration instruction sent by the timing controller, wherein the identity configuration instruction comprises the identity identification to be assigned;

a sub-detector configured for detecting a signal type of a signal on the target second signal line, wherein the signal type may comprise an unconventional signal or a conventional signal; and a sub-determiner configured for determining the identity identification to be assigned in the identity configuration instruction as the identity identification of the source driver when the signal on the target second signal line is the unconventional signal, wherein the unconventional signal is different from the conventional signal, and the conventional signal is a signal transmitted by the second signal line when working normally.

15. The drive control assembly as claimed in claim 14, wherein the sender is further configured to perform operations comprising:

sending an identity configuration response instruction to the timing controller, wherein the identity configuration response instruction comprises the identity identification that has been assigned to the source driver.

16. The drive control assembly as claimed in claim 14, wherein the second signal line comprises a differential signal line comprising 2 sub-signal lines, and wherein the sub-detector is configured to perform operations comprising:

detecting signals on the 2 sub-signal lines in the target second signal line;

determining that the signal on the target second signal line is the unconventional signal when the signals on the 2 sub-signal lines are at a same level; and determining that the signal on the target second signal line is the conventional signal when the signals on the 2 sub-signal lines are at different levels.

17. A display device comprising:

a timing controller and a source driver;

wherein the timing controller comprising the drive control assembly as claimed in claim 11; and wherein the source driver comprises a drive control assembly for a source driver, wherein the source driver is one of a plurality of source drivers, wherein the plurality of source drivers are connected in parallel and coupled to the timing controller via first signal lines, the drive control assembly comprising:

a receiver configured for receiving a point-to-point configuration instruction sent by the timing controller via the first signal lines, wherein the point-to-point configuration instruction comprises an identity identification;

a detector configured for detecting whether the identity identification in the point-to-point configuration instruction is that of the source driver; and a sender configured for sending a configuration response instruction to the timing controller via the one of the first signal lines in response to the point-to-point configuration instruction after it is determined that the identity identification in the point-to-point configuration instruction is that of the source driver.

* * * * *